US008987640B2

(12) United States Patent
Evans

(10) Patent No.: US 8,987,640 B2
(45) **Date of Patent: *Mar. 24, 2015**

(54) AXIAL RESISTANCE SHEATHED HEATER

(71) Applicant: Infinity Fluids Corp, Sturbridge, MA (US)

(72) Inventor: Robert Evans, Worcester, MA (US)

(73) Assignee: Infinity Fluids Corp, Sturbridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/923,627

(22) Filed: Jun. 21, 2013

(65) Prior Publication Data

US 2013/0284717 A1 Oct. 31, 2013

Related U.S. Application Data

(63) Continuation of application No. 12/878,823, filed on Sep. 9, 2010, now Pat. No. 8,497,452.

(51) Int. Cl.

| | |
|---|---|
| ***F23Q 7/22*** | (2006.01) |
| ***H05B 3/44*** | (2006.01) |
| ***H05B 3/48*** | (2006.01) |
| *H05B 3/40* | (2006.01) |

(52) U.S. Cl.
CPC ... *H05B 3/44* (2013.01); *H05B 3/48* (2013.01)
USPC ..... 219/270; 219/522; 392/497; 338/296

(58) Field of Classification Search
USPC ..... 219/270, 522, 544, 546, 548, 538, 541; 338/296, 302–3, 238, 242–3; 392/497–8
See application file for complete search history.

(56) References Cited

U.S. PATENT DOCUMENTS

| | | | | |
|---|---|---|---|---|
| 5,034,595 | A * | 7/1991 | Grendys | 219/541 |
| 5,408,579 | A * | 4/1995 | Hunt | 392/498 |
| 5,644,835 | A | 7/1997 | Villringer | |
| 6,963,053 | B2 * | 11/2005 | Lutz | 219/534 |
| 7,019,269 | B2 * | 3/2006 | Okuda | 219/544 |

FOREIGN PATENT DOCUMENTS

| | | |
|---|---|---|
| FR | 934031 | 5/1948 |
| FR | 1308042 | 11/1962 |
| GB | 821602 | 10/1959 |

OTHER PUBLICATIONS

EP Search Report Sep. 11, 2012, pp. 1-7.

* cited by examiner

*Primary Examiner* — Shawntina Fuqua
(74) *Attorney, Agent, or Firm* — Anderson Gorecki & Rouille LLP

(57) ABSTRACT

An axial resistance sheathed heater is presented. The axial resistance sheathed heater includes a retaining sheath having a first end and a second end and a resistance wire completely disposed within the retaining sheath. The heater further includes a first conductor rod partially disposed within the retaining sheath and extending beyond the first end of the retaining sheath, the first conductor rod in direct electrical communication and direct mechanical communication with the resistance wire; and a second conductor rod partially disposed within said retaining sheath and extending beyond the second end of the retaining sheath, the second conductor rod in direct electrical communication and direct mechanical communication with the resistance wire. The resistance wire, the first conductor rod and the second conductor rod comprise a circuit achieving a power to voltage rating of about 5000:24.

14 Claims, 2 Drawing Sheets

AXIAL RESISTANCE SHEATHED HEATER

CROSS REFERENCE TO RELATED APPLICATIONS

The present application is a continuation of U.S. patent application Ser. No. 12/878,823, filed on Sep. 9, 2010, which is incorporated herein by reference in its entirety.

BACKGROUND

The standard sheathed resistance element has been around for many decades. These standard elements typically use a spiral wound resistance wire with conductor leads on both ends, surrounded by dielectric and heat transfer material and compacted to extend the thermal and dielectric capabilities and make it formable with common bending practices. One of the limitations associated with the use of a coiled resistance element which per lineal inch of heater cause the fast buildup of resistance even with heavier resistance wires which would need to be wound on a very tight coil pattern to fit into a marginally sized tubular sheath. These units are excellent choices for common heating systems that do not demand the spatial conservation or ultra low resistances and disproportional large power levels. Standard maximum power:voltage (p:v) ratios for these customary units are 2000:120 (18 amps).

Other heater elements which are used in special resistive heating situations are the single ended compacted tubular elements which help overcome some of the built in deficiencies of the customary heater element designs described above. These units use a hairpin style resistive element within a compacted tubular sheath, giving it greater flexibility and usefulness in smaller equipment or process footprints. These would not lend themselves useful in low voltage high power applications as the system would need to accommodate the use of side-by-side massive conductor legs. This would make the heater sheath too massive for space constrained operations, also the mass of the element would cause a innate thermal burden on the resistive wire causing the resistance wire to prematurely expire. Standard theoretical p:v ratio achieved by such a unit could be up to 750:120 (6.25 amps) however the likelihood of heater longevity would be difficult to ascertain without formal study.

The final notable compacted sheath style heating element we observe is the single line style heater element (seen in U.S. Pat. No. 6,456,785 to Evans). This design overcomes further the deficiencies of the single ended heater design with hairpin resistive circuit by using straight single line resistance wire further compacted with slide splice ends and small diameter conductor pins the unit steps closer to achieving greater p:v ratios up to 2500:120 (21 amps) as a standard maximum. Auxiliary cooling and specialized conductor materials are required to achieve greater ratios so that the conductor pins do not overheat and melt making the unit difficult to commercialize and produce. With the low voltages the naturally occurring oxide layers developing between the resistance wire and the slide splice create a resistive break causing the unit to lose continuity after several hours of operation.

SUMMARY

Prior to the present invention, designing a practical compacted sheathed resistance heating element for low voltage-high power systems was not possible in a spatially practical single circuit design. With the advent of larger more powerful on-board power systems in all types of vehicles and shipboard processes, including electro-chemical battery supplies, fuel cells and hybridized electrical systems there is an increased capability associated with what is considered standard power overhead. The new systems make possible the use of resistive heating loads to replace the loss of internal combustion engines which would commonly produce waste energy in the form of heat to provide cabin heating. Power packs capable of large electrical discharge to produce heat for increasing the latent voltages seen in electro-chemical batteries or fuel cell systems which naturally produce greater potential at elevated temperatures.

The current invention also allows for a natural thermal management of the atypical current draw, whereas the leads will not require additional or specially constructed cooling to keep them within customary tolerance. These atypical current draws are not uncommonly up to 250 amps per circuit, whereas the source voltage is a nominal 24 volts and the power output is 6 kW, this circuit would yield a required resistive level of 0.096.

Embodiments of the invention significantly overcome such deficiencies and provide mechanisms and techniques that provide an axial resistance sheathed heater. The features of the invention, as explained herein, may be employed in devices such as those manufactured by Infinity Fluids Corp. of Sturbridge, Mass.

Note that each of the different features, techniques, configurations, etc. discussed in this disclosure can be executed independently or in combination. Accordingly, the present invention can be embodied and viewed in many different ways. Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views.

The drawings are not necessarily to scale, emphasis instead being placed upon illustrating the principles of the invention.

DETAILED DESCRIPTION

In the electric heating industry there are many common designs which allow for customary heating of processes where higher voltages and large power production is required with standard sheath style compacted heater elements. Standard voltages from 90-575 volts are compensated for with higher resistances and increased sheath diameters. This also helps to mitigate the current flow across the element by increasing the potential across the circuit the natural response is to decrease the current flow. These designs are not as useful when lower voltages and greater powers are required as the lengths required to achieve lower power density makes them implausible to produce with any practical design. There are notable exceptions which address the lower resistances with greater surface areas to decrease the power density across the circuit like U.S. Pat. No. 6,456,785 issued to Evans, however this design fails to account for the greater amperages while maintaining power levels at lower voltages. The limiting factor is the cross sectional limitation of the splice, this does not allow large amperage flows across the circuit without causing the conductor pin and the slide splice to become too hot for sustainable application due to the inherent diameter restrictions.

With the new design, large power scheduling, decreased resistive requirements and non-standard amperage flows are overcome by the inherent design of the present invention. The present invention uses a bored conductor rod made from very low resistance metal or alloy, nickel 200, carbon alloy metals, copper alloy, etc. or larger diameter reduced tubing with greater cross section, allowing it to carry the substantial amperage loads associated with these low potential high output applications. These loads become exacerbated by the low-level voltage supply commonly seen in on board systems such as marine, automotive, space and military applications. It also allows the element to accommodate the large amperage flows associated with lower voltage higher amperage applications, such as marine.

Figure 1:
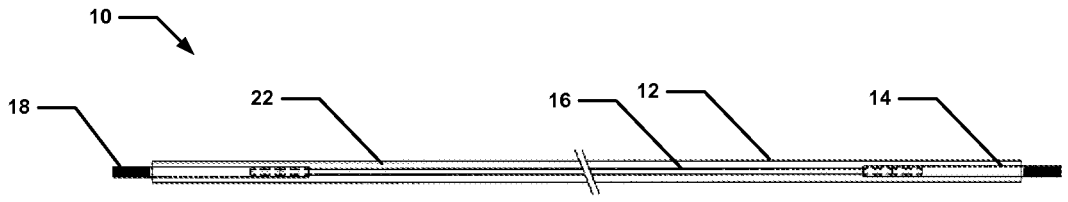
FIG. 1 comprises a cross-sectional view of a first embodiment of an axial resistance sheathed heater in accordance with embodiments of the invention.
Figure 2:
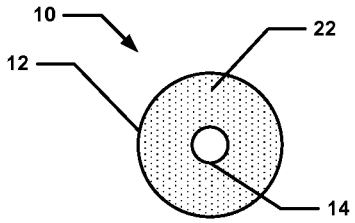
FIG. 2 comprises a cross-sectional end view of the axial resistance sheathed heater of FIG. 1 prior to reduction in accordance with embodiments of the invention.
Figure 3:
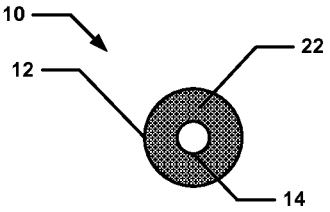
FIG. 3 comprises a cross-sectional end view of the axial resistance sheathed heater of FIG. 1 after reduction in accordance with embodiments of the invention.

Referring now to FIGS. 1-3, a first embodiment of an axial resistance sheathed heater 10 is shown. Heater 10 includes a conductor rod 14 of greater diameter which is then reduced in diameter over the outside of the resistance wire 16 or joined with metal addition, overcomes the natural continuity breaking oxide buildup potential, creating an indefinitely stable circuit. Carrying this concentric reduced diameter conductor rod 14 out of the exposed ends of retaining sheath 12 allows for very high amp capacity and reduces the possibility of further resistive breaks in the conductor legs at elevated amperage and temperatures, characteristics without the use of specialized materials or auxiliary cooling required as to not overheat and melt the conductor rods. By using the present invention achieving greater r:p ratios up to @5000:24 (208 amps) as a standard maximum is achievable and stable with non-auxiliary cooled conductor rods. This element would then be set into a flow housing exposing the naturally heated portion of the heater to the fluid or flow stream. The non-heated section would be isolated through a feed through device exposing the terminal/cold legs of the heater to ambient conditions where an operator or electrician would be capable of servicing the unit.

The present invention entails the use several components some standard materials found in customary heater product design, such as the dielectric heat transfer material 22 (e.g., Magnesium Oxide granules), used to envelop the resistance wire 16 and shield it from contact with the retaining sheath 12. The resistance wire is comprised of a material such as nickel chromium wire, or suitable resistance wire or ribbon material such as stainless steel, alumel, nickel etc. Suitable retaining sheath 12 materials which maintain the ability to be reduced in diameter for the compaction process, mostly this material will be stainless steels, copper, alloy 800 etc. Low resistance machinable conductor leads 18, manufactured from carbon/alloy steels, copper, brass etc.

These components are assembled in such a manner that a low ohm, high amperage heater can safely operate without the requirement of the non-fluid contact conductor ends being cooled by separate process or stream.

The present invention will have an axial resistance wire 16 embedded within a tubular retaining sheath 12. This resistance wire 16 is selected to achieve a given resistance according to both the wattage and voltage being applied to it in the process. The resistance wire 16 is introduced by a high amperage conductor rod or tube 14. The conductor rod 14 is reduced or affixed to the resistance rod/wire 16 prior to the introduction of the dielectric material 22. The connection of the resistance wire to the rod may be achieved by having mating threads on each which are mated together or by standard metal joining techniques (including but not limited to welding, brazing, soldering or the like). The dielectric material 22 may be in the form of cast or extruded or granule spacing bodies. The tubular retaining sheath 12 is positioned over the entire length of the resistance wire 16 and major portion of the conductor rods 14. The conductor rods 14 will extend beyond the boundary edge of the sheath 12 so that the heater circuit may be electrified after final manufacturing. The dielectric heat transfer material 22 is used to surround the resistive wire 16 within the retaining sheath 12 such that the resistive wire 16 is not in contact with the tubular retaining sheath 12. The entire length of the tubular sheath 12, dielectric heat transfer material 22 and the resistive wire 16 will be reduced in diameter by convention roll or rotary reduction technology. The heater 10 in some instances will not need to be reduced assuming the proper casting material or dielectric materials are selected and implemented. FIG. 2 shows the heater of FIG. 1 before the compacting process, and FIG. 3 shows the heater of FIG. 1 after the compacting process.

Figure 4:
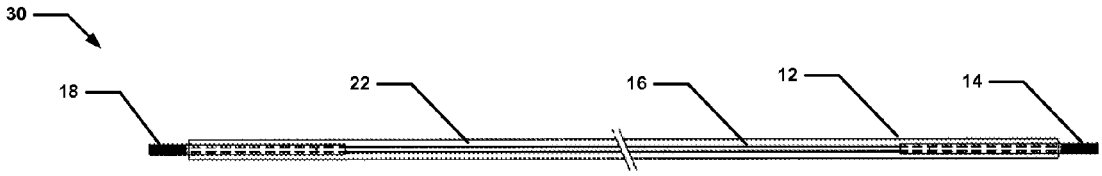
FIG. 4 comprises a cross-sectional view of a second embodiment of an axial resistance sheathed heater in accordance with embodiments of the invention.
Figure 5:
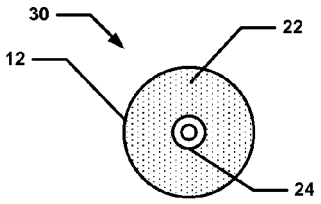
FIG. 5 comprises a cross-sectional end view of the axial resistance sheathed heater of FIG. 4 prior to reduction in accordance with embodiments of the invention.
Figure 6:
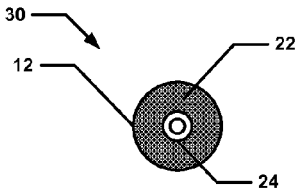
FIG. 6 comprises a cross-sectional end view of the axial resistance sheathed heater of FIG. 4 after reduction in accordance with embodiments of the invention.

FIGS. 4, 5 and 6 are similar to FIGS. 1, 2 and 3 respectively, except that in the embodiment of the heater 30 shown in FIGS. 3, 4 and 5 the conductor rods 24 have a bore extending the length of the rod, whereas the conductor rods 14 of the heater 10 shown in FIG. 1 have a bore extending only partially therein.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

What is claimed is:

1. A sheathed resistive heating element comprising:

a retaining sheath having a first end and a second end;

a resistance wire completely disposed within said retaining sheath;

a first conductor rod partially disposed within said retaining sheath and extending beyond said first end of said retaining sheath, said first conductor rod in direct electrical communication and direct mechanical communication with said resistance wire and wherein said resistance wire is partially disposed within said first conductor rod; and a second conductor rod partially disposed within said retaining sheath and extending beyond said second end of said retaining sheath, said second conductor rod in direct electrical communication and direct mechanical communication with said resistance wire and wherein said resistance wire is partially disposed within said second conductor rod, and wherein said retaining sheath is fully mechanically reduced in size after assembly of said sheathed resistive heating element.

2. The sheathed resistive heating element of claim 1 further comprising dielectric heat transfer material disposed between said resistance wire and an inner surface of said retaining sheath.

3. The sheathed resistive heating element of claim 1 wherein at least one of said first conductor rod and said second conductor rod comprises a solid rod having a bore partially extending therein.

4. The sheathed resistive heating element of claim 1 wherein at least one of said first conductor rod and said second conductor rod comprises a solid rod having a bore completely extending throughout.

5. The sheathed resistive heating element of claim 1 wherein at least one of said first conductor rod and said second conductor rod are threaded on one end.

6. The sheathed resistive heating element of claim 1 wherein said resistance wire, said first conductor rod and second conductor rod comprise a circuit achieving a rating of about 208 amperes.

7. The sheathed resistive heating element of claim 1 wherein said resistance wire, said first conductor rod and second conductor rod comprise a circuit achieving a power to voltage rating of about 5000:24.

8. The sheathed resistive heating element of claim 1 wherein said first conductor rod is comprised of a material selected from the group consisting of carbon/alloy steels, copper, and brass.

9. The sheathed resistive heating element of claim 1 wherein said second conductor rod is comprised of a material selected from the group consisting of carbon/alloy steels, copper, and brass.

10. The sheathed resistive heating element of claim 2 wherein said dielectric heat transfer material comprises magnesium oxide.

11. The sheathed resistive heating element of claim 1 wherein said resistance wire is comprised of a material selected from the group consisting of nickel chromium, stainless steel, alumel, and nickel.

12. The sheathed resistive heating element of claim 1 wherein said retaining sheath is comprised of a material selected from the group consisting of stainless steels, copper, and alloy 800.

13. The sheathed resistive heating element of claim 5 wherein said at least one of said first conductor rod and said second conductor rod are threaded to allow for high amperage mechanical connection.

14. The sheathed resistive heating element of claim 1 wherein said resistance wire is in mechanical communication with said first conductor rod by way of mating threads.

* * * * *